United States Patent [19]

Long et al.

[11] 4,426,899

[45] Jan. 24, 1984

[54] APPARATUS FOR PUNCHING HOLES IN TUBING

[75] Inventors: Kelso M. Long; Leonard Pharr, both of Ringgold; Earl J. Pharr, Rossville, all of Ga.

[73] Assignee: Burner Systems International, Inc., Chattanooga, Tenn.

[21] Appl. No.: 238,239

[22] Filed: Feb. 25, 1981

Related U.S. Application Data

[63] Continuation-in-part of Ser. No. 76,046, Sep. 17, 1979, Pat. No. 4,269,098.

[51] Int. Cl.[3] ..... B26D 5/24; B21D 28/22

[52] U.S. Cl. ..... 83/188; 83/257; 83/277; 83/278

[58] Field of Search ..... 83/188, 257, 277, 278, 83/222

[56] References Cited

U.S. PATENT DOCUMENTS

| | | | |
|---|---|---|---|
| 557,107 | 2/1897 | Leavitt | 277/69 |
| 653,955 | 7/1900 | Gordon | 83/240 |
| 886,551 | 5/1908 | Thomas | 83/257 |
| 1,175,195 | 3/1916 | Thomas | 83/251 |
| 1,175,196 | 3/1916 | Thomas | 83/251 |
| 1,305,972 | 6/1919 | Pearne | 29/34 B |
| 1,391,923 | 9/1921 | Vick | 192/17 R |
| 1,566,082 | 12/1925 | Dugins | 83/69 |
| 2,065,621 | 12/1936 | Simmons | 164/23 |
| 2,164,806 | 7/1939 | Eickman | 164/22 |
| 2,829,983 | 4/1958 | De Gain | 164/108 |
| 3,171,312 | 3/1965 | Fuchs, Jr. et al. . | |
| 3,231,099 | 1/1966 | Kidd | 214/1.7 |
| 3,698,274 | 10/1972 | Coulon et al. | 83/188 |
| 3,738,209 | 6/1973 | Davis | 83/98 |
| 4,269,094 | 5/1981 | Long et al. | 83/188 |

*Primary Examiner*—Donald R. Schran

*Attorney, Agent, or Firm*—David H. Semmes; Warren E. Olsen

[57] ABSTRACT

Gas burners; particularly, apparatus for punching holes or ports in gas burner tubing. The apparatus includes a base and superposed frame, a press head with punch, which is reciprocally mounted in the upper part of the frame and a rotatably driven eccentric shaft which engages, so as to reciprocate the press head. As the press head reciprocates, the punch engages the receiving end of a gas burner tubing which is supported in a tube collar positioned within the lower part of the frame. The trailing end of the tubing is supported upon a tube arbor which is advanced incrementally towards the tube collar, as the punch is reciprocated. The apparatus is characterized by its capability of rapid punching of a longitudinally aligned series of ports in a gas burner tubing, with precise adjustment of port size and distance between ports.

5 Claims, 10 Drawing Figures

CLUTCH ENGAGED

CLUTCH DISENGAGED

APPARATUS FOR PUNCHING HOLES IN TUBING

CROSS REFERENCES TO RELATED APPLICATIONS

A continuation-in-part of DEVICE FOR PUNCHING HOLES IN TUBING (Ser. No. 076,046), filed Sept. 17, 1979, and issued as U.S. Pat. No. 4,269,098.

The present invention is directed principally to improvements in the press or ram head assembly, a drive means stop or cut off and a taper block adjustment for the tube collar.

BACKGROUND OF THE INVENTION (1) Field of the Invention

Gas burner systems, particularly means for punching holes in cylindrical tubing of the type used in gas burners.

2. Description of the Prior Art

A. Cited by applicant in the parent application, U.S. Pat. Nos. PLOST—1,054,143; PEARNE—1,305,972; SMITH—2,296,483; REID—3,094,158; MUNSCHAUER—3,099,180; KIDD—3,231,099; SERAVIN—3,266,356; BRANSON—3,540,258; BROWN—3,678,718; DAVIS—3,738,209; FOULKS—3,815,399.

B. Cited by The Examiner in the parent application, U.S. Pat. Nos. SCHADOW—1,250,028; COULON et al.—3,698,274; CIBS—2,404,901; FUCHS et al.—3,171,312; DE GAIN—2,829,983; DUGINS—1,566,082; COOPER—3,086,571; SCHAEFER—3,771,400.

The present application is distinguished from the references in its braking control of the reciprocating punch, switching off the device as punching in the tubing is completed and precision vertical adjustment of the tubing with respect to the punch, so as to vary the size of ports being punched, and precision adjustment of the drive system for varying the horizontal distance between ports.

SUMMARY OF THE INVENTION

Apparatus for punching holes in gas burner tubing and the like, including a base and a frame vertically superposed with respect to said base, such that a press head is reciprocally mounted in the upper part of said frame and is engaged by a rotatably driven eccentric shaft. A vertically adjustable punch is mounted in the press head, so as to engage a receiving end tubing supported in a tube collar positioned in the frame beneath said punch. The opposite end of the tubing is supported upon a longitudinally reciprocable tube arbor, while the belt driven eccentric shaft is linked to the tube arbor by a single chain drive, so as to synchronously advance the tubing in increments for each sequential punch. A stop is provided to disengage the eccentric shaft clutch and stop punching, as the tube is completed and various means for precisely adjusting the distance between ports and the size of ports are provided.

DESCRIPTION OF THE PREFERRED EMBODIMENTS

Figure 1:
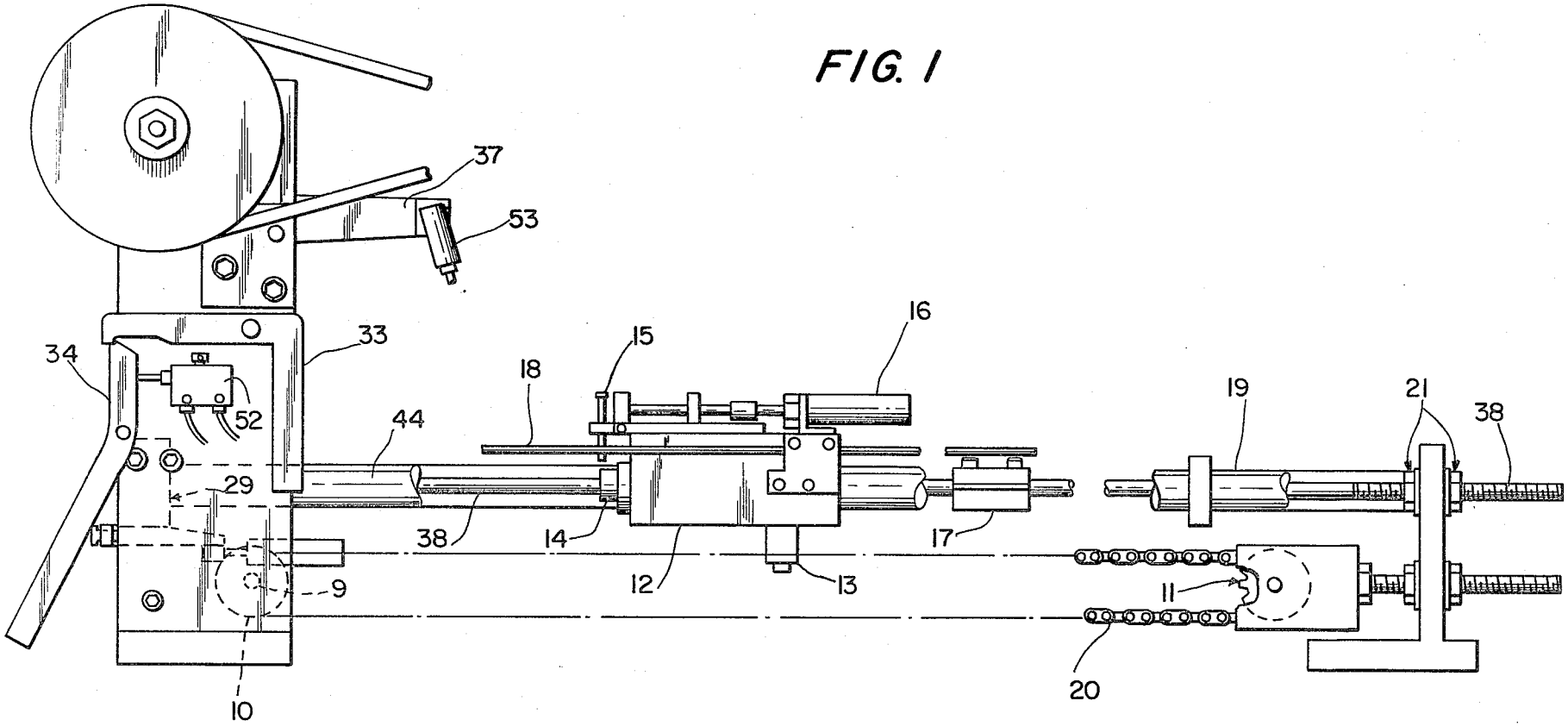
FIG. 1 is a side elevation, (partially fragmentary), showing positioning of the longitudinally movable tube arbor assembly with respect to the press head, including a belt driven eccentric shaft.
Figures 2, 10:
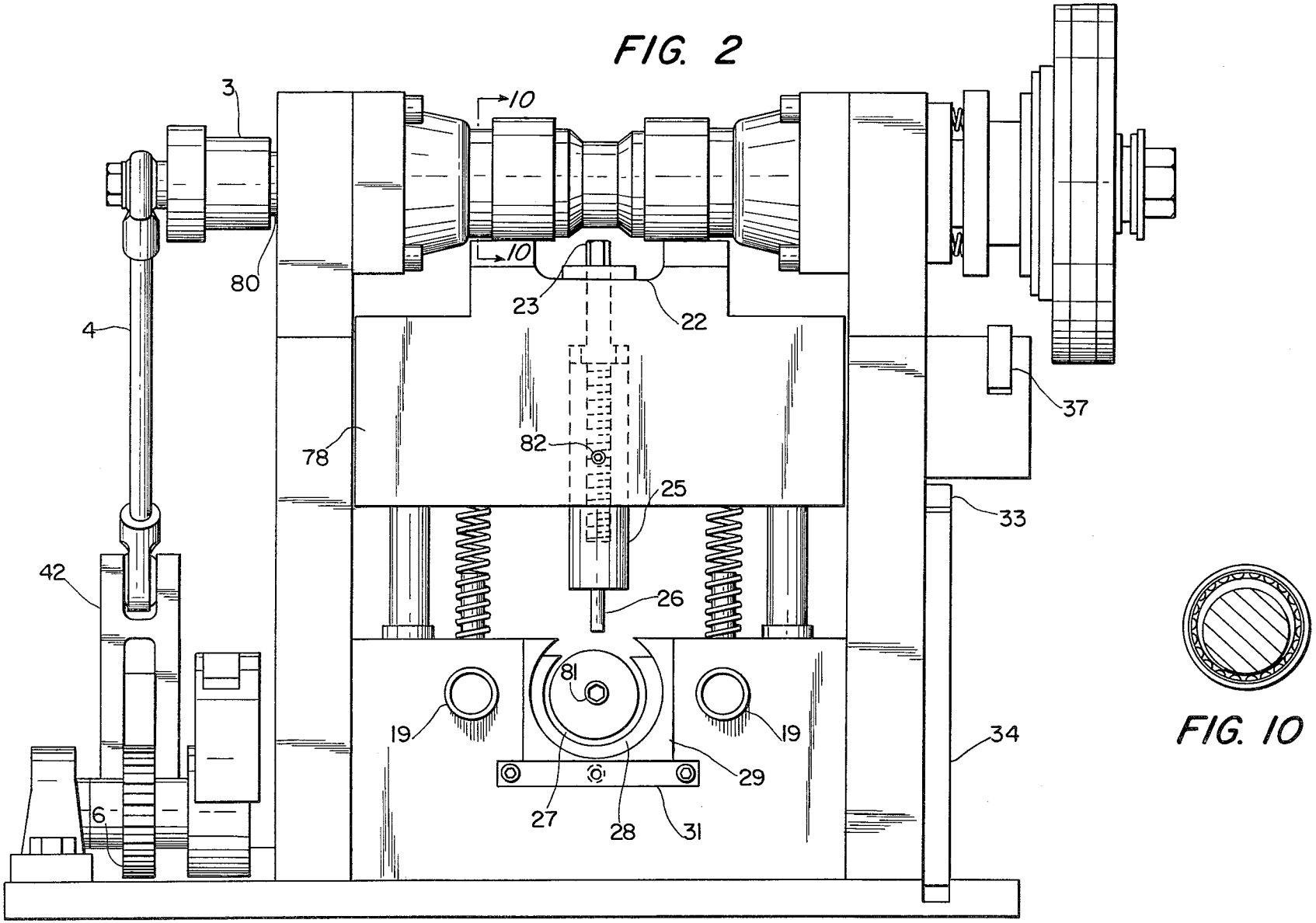
FIG. 2 is a end elevation, showing positioning of the eccentric shaft, reciprocable press head and punch with respect to the tube collar.
Figure 3:
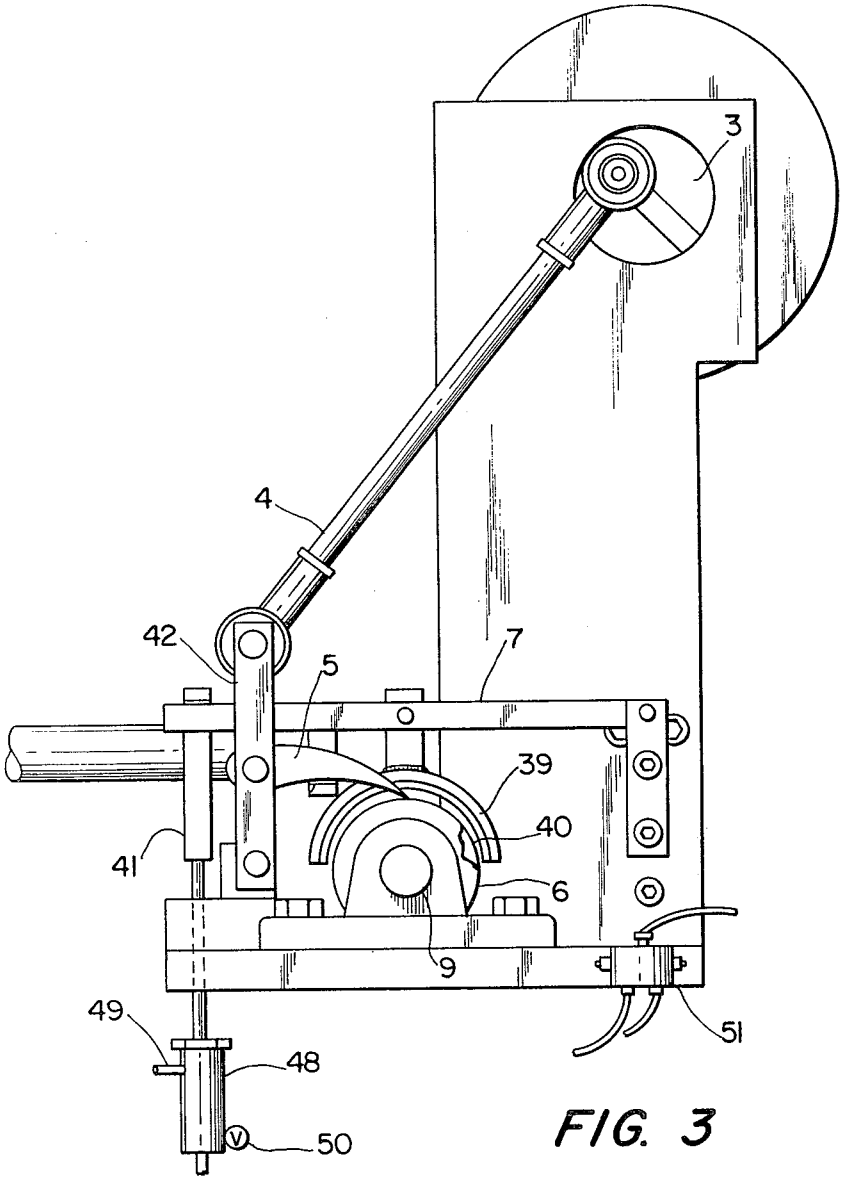
FIG. 3 is a side elevation of the linkage between the eccentric shaft and the drive sprocket for synchronously advancing the drive chain, while reciprocating the punch.
Figure 5:
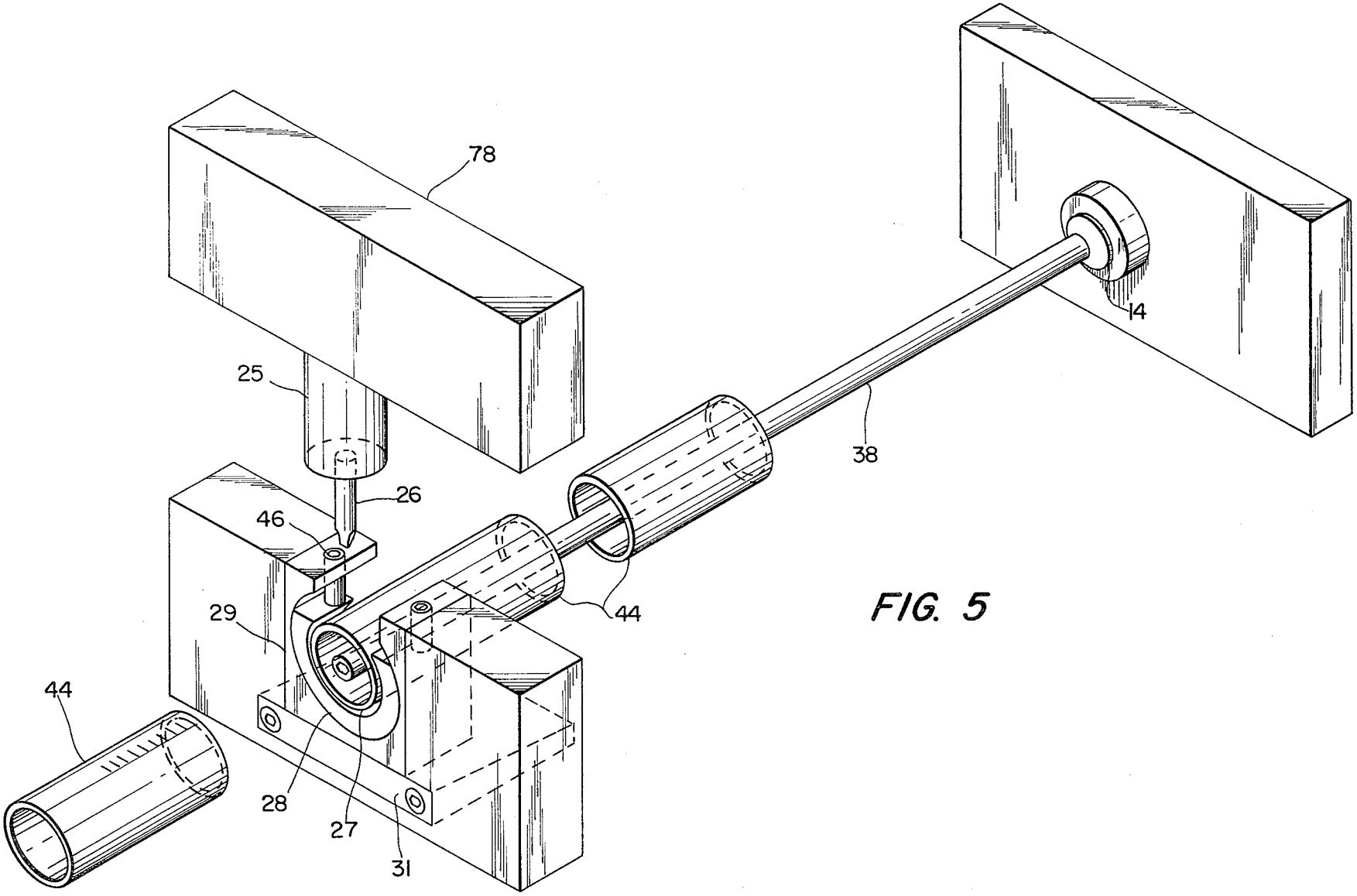
FIG. 5 is an exploded perspective, showing positioning of the tube being punched upon rod 38 and within the tube collar.

As illustrated in FIGS. 1, 2 and 5, the receiving end of a tube 44 to be punched is placed through tube collar 28 and passed over punch arbor 27. Tube 44 at its other end is placed over tube arbor 14 and locked into position by tube-holding pin 15. As illustrated in FIG. 5, tube collar 28 is held within arbor guide holder 29 by means of two set screws 46. As illustrated in FIGS. 1 and 3, tube holding pin 15 is activated by air cylinder 16, which synchronously activates air cylinder 48, so as to move brake arm 7 into position for brake 39 to engage drum 40 adjacent ratchet arm pawl 5.

Figure 4A:
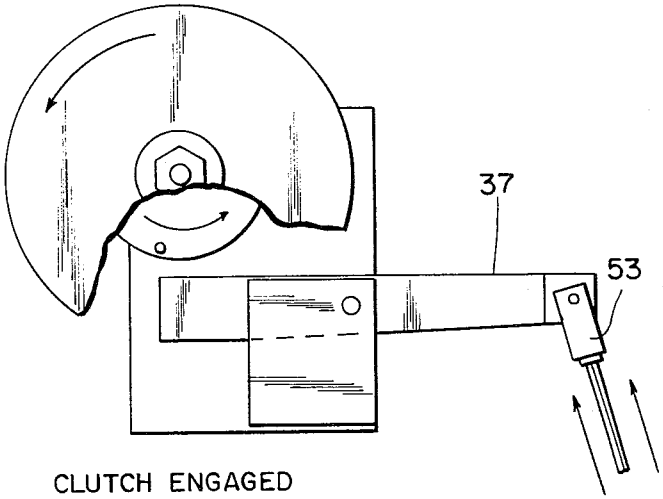
FIG. 4A is a fragmentary side elevation, showing the eccentric shaft clutch engaged.

As illustrated in FIGS. 1, 2 and 4, clutch cylinder actuating arm 34 is pivotably positioned to engage pivoted actuating arm pawl 33, thence trip air valve 52, so as to activate an air cylinder 53 to position clutch trip arm 37, thus starting the vertical reciprocatory movement of upper ram or press head 78 which holds punch holder 25 and punch 26 of varying size and configuration.

Figure 9:
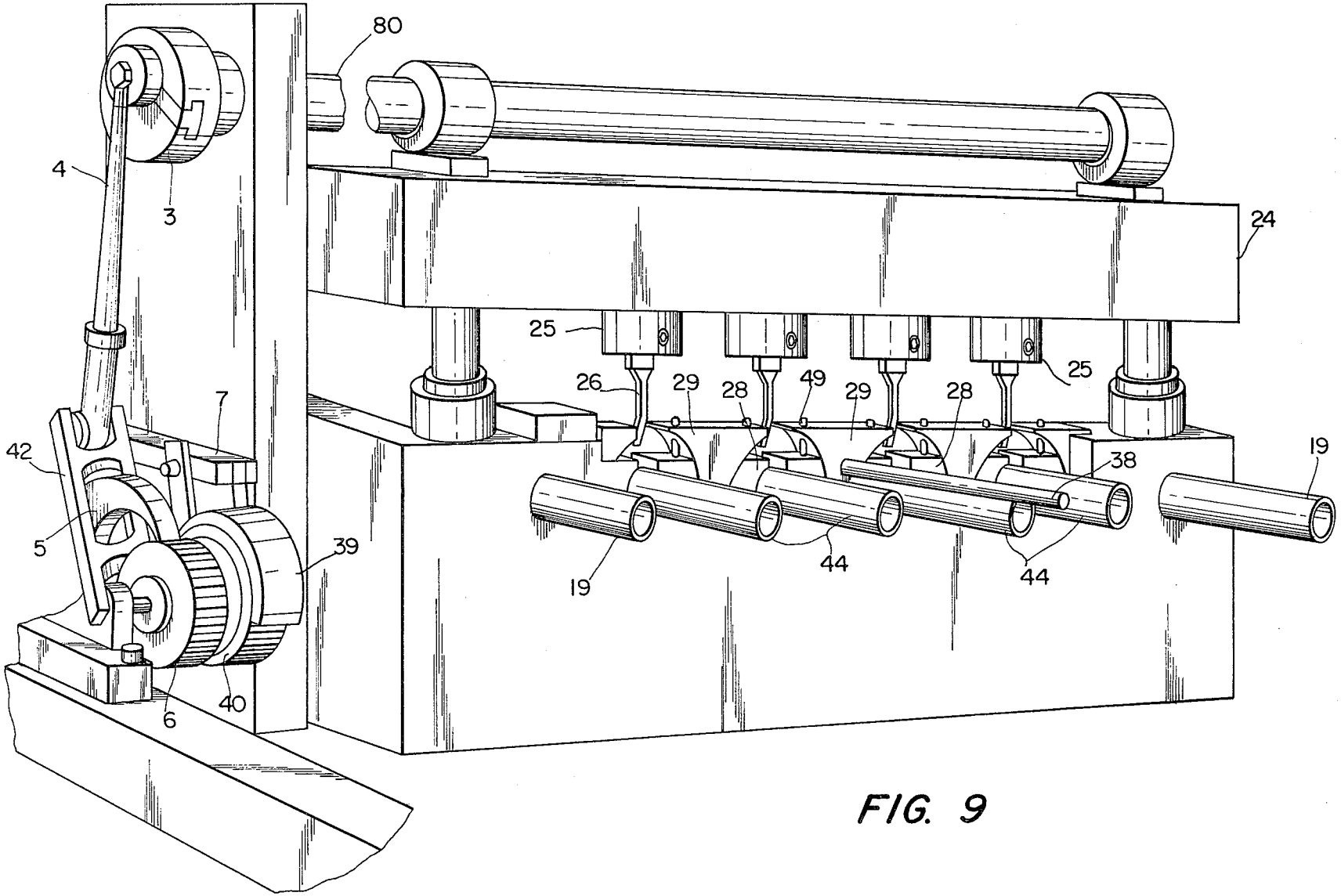
FIG. 9 is a fragmentary perspective showing a modified apparatus wherein horizontal shaft 80 is provided with dual eccentrics 81 and 82 engaging corresponding plates 83, 84 on top of a modified press head, so as to simultaneously reciprocate four punches, each punch having corresponding tube collars and tube arbors (not illustrated).

As illustrated in FIGS. 2, 3 and 9, connector collar 3 is activated by an eccentric crank shaft 80. Connecting rod 4 is locked eccentrically in a "T" slot on shaft 80, so as to give a predetermined eccentric movement to connecting rod 4. This eccentric movement of connecting rod 4 reciprocates ratchet pivot arm 42 and attached ratchet arm pawl 5 into notches or teeth on ratchet gear 6.

As illustrated in FIGS. 1 and 3, circular movement of ratchet gear 6 is transferred through ratchet drive shaft 9 to sprocket drive gear 10. As illustrated in FIG. 1, sprocket chain 20, encircling sprocket gears 10 and 11 is connected to tube holder assembly 12 by means of conventional assembly fastener 13.

Figure 8:
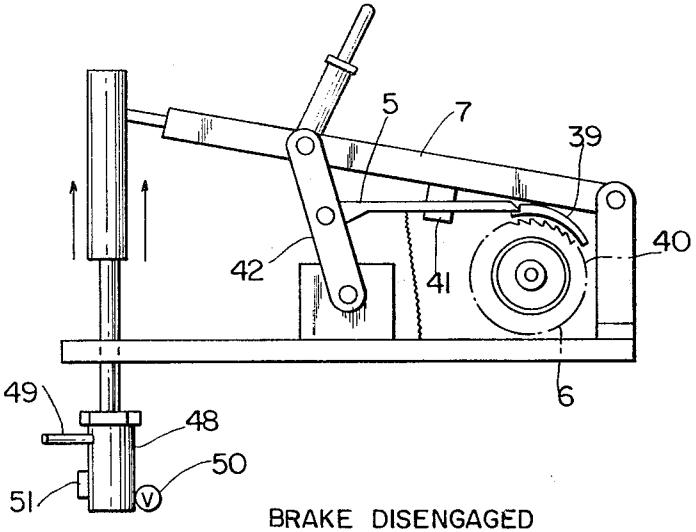
FIG. 8 is a fragmentary side elevation, along the lines of FIG. 7, showing the "brake disengaged" position, as air cylinder 48 raises brake arm 7.
Figure 7:
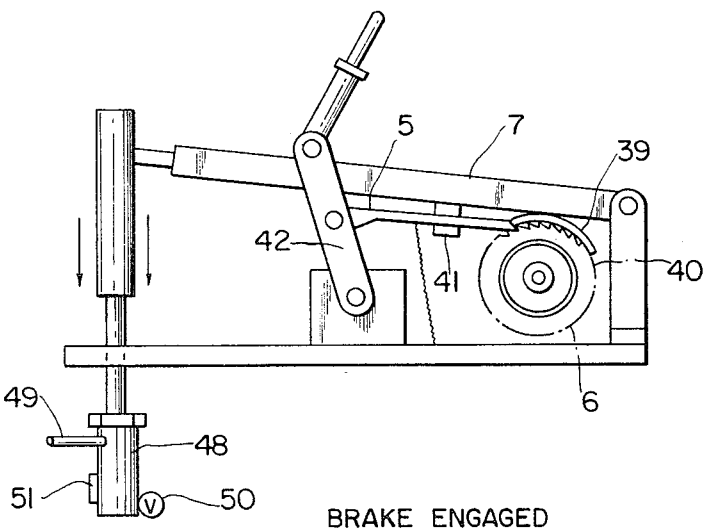
FIG. 7 is a fragmentary side elevation, along the lines of FIG. 3, showing the air cylinder depressing contact arm 5, so as to urge brake 39 against brake hub 40 in "brake engaged" position.

Since press head 78 and sprocket chain 20 will be moving at a very rapid pace, loose motion is controlled by sprocket idler gear 11, as well as brake 39, actuated mechanically by suitable air cylinder 48, having a conventional air hose 49 feeding system, a conventional bleed off valve 50 and manual control 51 or the like, to engage brake hub 39, as illustrated in FIGS. 7 and 8. This braking action provides a positive limitation for each longitudinal advance of the chain drive, so as to eliminate over advancing of the chain drive as a result of momentum. Using this braking control in the single barrel mode, approximately 500 punching strokes of punch 26 per minute have been achieved. In the multi-barrel mode, as illustrated in FIG. 9, approximately 200 punching strokes per minute have been achieved.

Figure 4B:
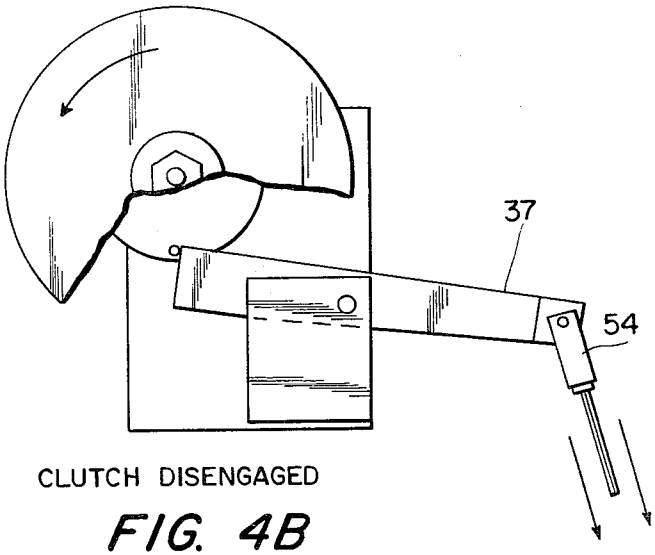
FIG. 4B is a side elevation, showing the eccentric shaft clutch disengaged.

As illustrated in FIGS. 1 and 5, tube holder assembly 12 movement is terminated by adjustable stop rod 18, when rod 18 is driven forwardly enough to make contact with actuating arm pawl 33. As rod 18 pivots pawl 33, so as to release arm 34, actuating arm 34 pivots away from air valve 52, thereby deactivating clutch trip arm 37, thus stopping clutch engagement on press head 78, as illustrated in FIG. 4B. Manifestly, the movement may be controlled or terminated through suitable electronic sensing devices, (i.e., counters coupled with a proximity switch).

As illustrated in FIG. 2, the vertical length or punching operation stroke of punch 26 is adjusted by punch adjustment screw 23 which is locked into position by screw collar 22 as well as set screw 82. Reciprocative vertical movement of upper press head or ram 78, projects punch 26 into tube or sheet metal 44 at a constant stroke. Tube 44 is supported by punch arbor 27, as shown in FIGS. 2 and 5.

If the opening obtained by the punching operation is required to be smaller, the tube material 44 may be moved downwardly away from the stroke of punch 26 by activating taper block cam 31, illustrated in FIGS. 1, 2 and 5 and allowing tube collar holder 29 to rest upon the thinner portion of taper block 31.

The activation of taper block cam 31 may be accomplished by means of a tapered rod or angle to activate an air valve to control an air cylinder, as the tube holder assembly 12 is indexed forward by the sprocket drive train or by other suitable electronic means, such as a conventional counter coupled with a proximity switch, as mentioned above.

The spacing of operations (i.e., distance between punching) on tube or sheet metal 44 may be varied by means of adjusting connecting rod 4 in the "T" slot or connector collar 3 to a more or less eccentric location. This will allow more or less stroke on connecting rod 4, which, thus, catches more or less teeth on ratchet gear 6. Also, of course, a different size gear 6 may be used with variously spaced teeth.

The tube holder assembly 12, illustrated in FIGS. 1 and 2, is indexed in a concentric manner to the tube supporting collar 28 by means of linear bearings (not illustrated) enclosed in tube holder assembly 12; mounted on the same center line plane and guided by two longitudinally extending guide bars 19.

Figure 6:
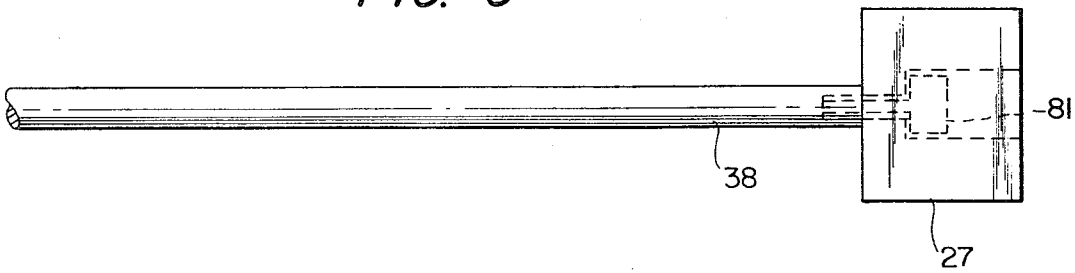
FIG. 6 is an fragmentary side elevation, showing support of one end of support rod 38 within the punch arbor.

As illustrated in FIGS. 1, 2 and 5, precision orientation of punch 26 with respect to punch arbor 27 and the desired punch or shear clearance is adjusted by means of a pair of threaded nuts 21, connected to punch arbor support rod 38. This is to provide adequate openings for operations performed upon the tubular material. As illustrated in FIG. 6, punch arbor support rod 38 is secured within punch arbor 27 by means of socket head screw 81.

At the end of the punching cycle, the next tube 44 of sheet metal is placed into position after air cylinder 48 connected to brake arm 7 is deactivated, as illustrated in FIG. 8, which releases brake 39 and pawl arm 5 from the notches or teeth in ratchet gear 6. This allows free movement or pushing of the tube holder assembly 12 into back position, while being limited by back stop 17, as illustrated in FIG. 1.

As will be apparent, the present apparatus may utilize a single chain drive system for horizontal moving of tube 44, as upper press ram 78 is actuated into a vertically reciprocating motion. This system enables the punching of as many as 12 ports per longitudinal inch of tubing, a capability which contrasts with the approximate 6 ports per longitudinal inch in conventional devices. Port size is, of course, controlled by changing the size of the punch. Also, changes in height of tube collar 28 and vertical stroke length of punch 26 may be undertaken to vary punch configuration.

Manifestly, the apparatus may be used for punching holes, extrusions, and lances in various sheet metal and tubing configurations without departing from the spirit of the invention.

We claim:

1. Apparatus for punching holes in tubing, comprising:

A. A base;

B. A frame supported on said base and extending vertically at one end thereof;

C. A rotatably driven eccentric drive shaft with clutch mechanism, supported upon an horizontal axis at the top of said frame;

D. A press head reciprocally supported in said frame beneath said drive shaft, so as to operatively engage said eccentric drive shaft, said press head including an adjustable, downwardly extending punch;

E. A tube collar supported within said frame and vertically adjustably aligned with respect to said punch, so as to circumferentially engage and position tubing being punched;

F. At least one tube arbor supported upon said base and movably positioned upon said base away from said tube collar, so as to engage an end of tubing being punched within said tube collar, while moving longitudinally toward said tube collar, each said tube arbor further including:

i. a horizontal guide means concentrically aligning said tube arbor with respect to said tube collar;

ii. a longitudinally extending guide, limiting longitudinal advance of said tube arbor toward said press head; and iii. a stop means supported upon said horizontal guide, so as to limit longitudinal movement of said tube arbor away from said tube collar; and iv. a drive means linked at one end to said punch and linked in another portion to said tube arbor, so as to move said tube arbor longitudinally, synchronously towards said tube collar with reciprocation of said punch, by said eccentric drive shaft.

2. Apparatus for punching holes in tubing as in claim 1, wherein a plurality of punches are supported in said press head in side-by-side array together with a plurality of corresponding tube collars being supported in said frame in alignment with each punch and a plurality of corresponding tube arbors being movably supported upon said base.

3. Apparatus for punching holes in tubing as in claim 1, said tube collar including a taper block cam, so as to adjust the height of said tube collar and thus the height of said tube collar with respect to said punch.

4. Apparatus for punching holes in tubing as in claim 3, said punch being threadedly engagable with said press head, so as to adjust the vertical depth of punch strokes with respect to said tube collar and tubing supported thereon.

5. Apparatus for punching holes in tubing as in claim 3, said drive means having a stop, further including:

(i) a clutch cylinder actuating arm pivoted upon said frame, (ii) a pivoted pawl mounted upon said frame in alignment with said longitudinally extending guide of said tube arbor and releasably engaging said clutch cylinder actuating arm; and (iii) an air cylinder supported upon said frame in abutment with said clutch cylinder actuating arm and in operative engagement with said eccentric cylinder clutch, so as to be tripped and disengage said clutch as said longitudinally extending guide abuts said pawl and said pivoted pawl releases said clutch cylinder actuating arm.

* * * * *